United States Patent [19]

Goldfarb

[11] 4,309,035

[45] Jan. 5, 1982

[54] ACTION GAME APPARATUS WITH ROTATING DISC DISPENSING UNIT

[76] Inventor: Adolph E. Goldfarb, 4614 Monarca Dr., Tarzana, Calif. 91356

[21] Appl. No.: 121,137

[22] Filed: Feb. 13, 1980

[51] Int. Cl.[3] ..... A63F 3/00

[52] U.S. Cl. ..... 273/237; 133/5 R; 273/144 R; 273/149 R; 273/273

[58] Field of Search ..... 273/237, 271, 273, 148 R, 273/149 R, 144 R; 133/5 R, 5 A, 5 B

[56] References Cited

U.S. PATENT DOCUMENTS

| | | | |
|---|---|---|---|
| 2,026,682 | 1/1936 | Jeffries | 273/148 R |
| 2,193,164 | 3/1940 | Cochran | 133/5 R |
| 3,845,958 | 11/1974 | Reinertsen | 273/273 |
| 4,111,429 | 9/1978 | Waski | 273/271 |
| 4,146,151 | 3/1979 | Davis | 133/5 R X |

*Primary Examiner*—Anton O. Oechsle

*Attorney, Agent, or Firm*—Romney, Golant, Disner & Ashen

[57] ABSTRACT

An action game comprising a unit for automatically and sequentially dispensing play pieces such as discs to a plurality of player stations. The players each attempt to match indicia, such as cutouts, on the discs dispensed to his or her station with indicia at that station to achieve an objective such as completing a row of discs. The illustrated unit includes a base on which a magazine for one or more stacks of the discs is rotatably mounted. As the magazine rotates, cam surfaces on the base and magazine engage discs from the bottoms of the stacks and cause such discs to be ejected outwardly to the respective player stations. When indicia do not match, the disc is put back in the magazine. The unit includes a mechanism for starting and stopping the rotation.

30 Claims, 9 Drawing Figures

ACTION GAME APPARATUS WITH ROTATING DISC DISPENSING UNIT

There have been various devices in the prior art to dispense objects to a plurality of players. In this connection there have been automatically card dealers which rotated so as to sequentially face each of the plurality of players, with means such as a friction roller engaging the top of the deck of cards to thereby sequentially deal cards to the players. Of more general interest, there have been a variety of game devices where means on a central unit rotated to sequentially expose different things to the respective players. For example a target was exposed to each player as the device rotated, with the Player trying to hit the target when it was in the right position and/or accessible as by having a doorway open. Similarly, the rotating central device might expose the players successively to pictures or other indicia, with the players being required to simulate or otherwise utilize indicia in the play of the game.

The present invention contemplates a new and improved game apparatus which utilizes a unique central dispensing unit for dispensing flat disk-like play pieces to the players in sequential order. The illustrated dispensing unit includes a base on which a rotatable magazine is mounted. The magazine has one or more compartments or hoppers, each for receiving a stack of the discs. Incident to the rotation of the magazine, discs from the bottom of the stacks are engaged by cam means and thereby automatically and sequentially dispensed outwardly to player stations positioned around the central unit. The dispensing unit operates at high speeds, accurately dispensing the discs each station in a smooth and efficient manner without jamming as may result from tilting or misaligning of the discs. The illustrated unit also includes chutes each leading to one of the player stations. The illustrated unit is battery operated and self-contained, and it includes a simple start/stop switch at its center; the switch is elevated to start the magazine rotating and depressed to stop the rotation. The discs may bear indicia which may be utilized by the players in the play of the game. For example, the indicia could be letters which players use to spell words or they could be numbers to be matched in sequences or other combinations such as in various card games. Indicia could also be used to match indicia at the player stations as by filling in positions on a card such as used for bingo or similar games. The illustrated discs have cut-outs of a number of different shapes, and each of the player stations has projections which match some but not all of the cut-out shapes. The players each try to match the projections at their respective stations with discs dispensed to them; they return to the magazine the discs which do not match their projections. The first player to match all of his or her projections with discs is the winner.

IN THE DRAWINGS

Figure 1A:
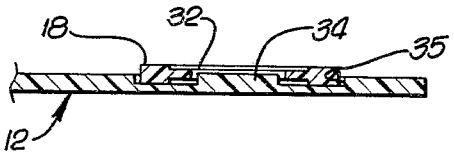
FIG. 1A is an enlarged sectional view taken generally along line 1A—1A of FIG. 1.

An improved action game apparatus 10, which embodies the presently preferred form of the invention, is illustrated in FIGS. 1 through 8. Broadly the apparatus 10 comprises a board 12 which is a generally flat circular member and a disc dispensing unit 14 which is adapted to the position centrally of the board. The board 12 defines four player stations 16 circumferentially equally spaced around the edge of the board. The apparatus 10 also includes a plurality of flat circular discs 18. The dispensing unit 14 includes a base 20 and a rotating magazine 22 which is mounted atop the base 20 for rotation about a generally central vertical axis X—X. The magazine 22 defines a pair of upright cylindrical hoppers or compartments 24 which are open at their upper ends and each adapted to receive a stack of the discs. As shown best in FIG. 1 the base 20 includes four downwardly extending chutes or ramps 26 which are each generally aligned with one of the player stations 16. Thus as the magazine 22 rotates, individual discs are dispensed one at a time down successive ramps to successive player stations. Rotation of the magazine is controlled by a centrally located vertically shiftable control member 28 which is raised to initiate rotation and depressed to stop further rotation. As will be explained in further detail below, the dispensing of the discs is accomplished simply and effectively by the provision of cam or guide surfaces 30, 124 on the magazine and base respectively which engage the bottommost discs in the stacks and, incident to continued rotation of the magazine, direct those discs radially outwardly and down associated ramps to player stations. The illustrated discs 18 each have a cutout 32 and each of the player stations 16 is provided with a plurality of projections 34. The discs 18 have a plurality of different cutouts 32 and each of the player stations has projections 34 matching some but not all of the cutouts 32. Thus when the discs are dispensed randomly each player may receive discs which match and others which do not. The non-matching discs are returned to the rotating magazine.

Now considering the illustrated apparatus 10 in further detail, the illustrated board 12 is as noted above generally flat and circular and it may be constructed of various suitable materials. Since the illustrated form of the game involves a plurality of raised projections 34, it is convenient and economical to provide the board 12 of molded plastic so that the projections 34 may be integrally formed therein. The illustrated board 12 is shown in FIG. 1 as having slightly elevated portions which define the four player stations 16, each outwardly of a ramp 26 on the dispensing unit. The elevated portions also define circular depressions 35 around each of the projections 34 to thereby accomodate the circular discs 18 as shown best in FIG. 1A. At the center of the board 12 a dispensing unit pad 42 may be provided for creating a good frictional interface with the underside of the dispensing unit. This pad 42 may be a separate piece such as rubberized mat or may be integrally formed with the board 12. The board may alternatively be made of cardboard and the projections could be molded plastic pieces secured to the cardboard.

Figure 7:
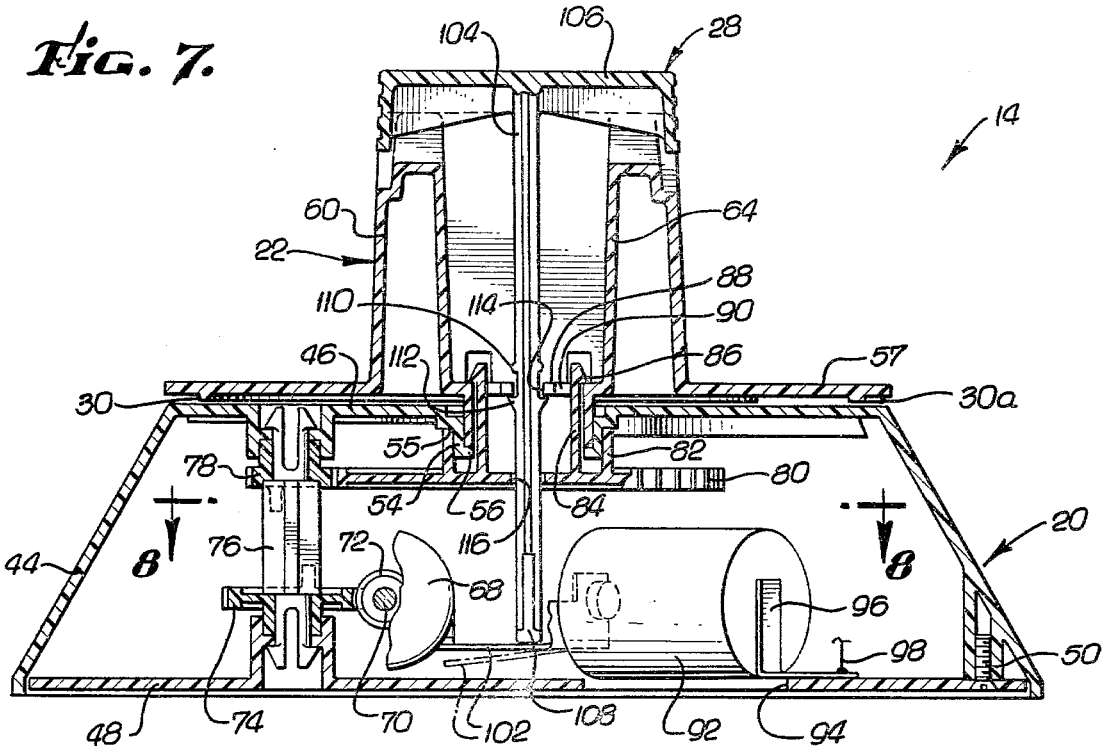
FIG. 7 is a sectional view taken generally along line 7—7 of FIG. 4.

The unique dispensing unit 14 is illustrated in FIGS. 2 through 8. More particularly, the base 20 has a generally frustoconically shaped side wall 44, a generally circular top wall 46, and a circular bottom wall 48. The side and top walls 44, 46 may be integrally formed while the bottom wall 48 is illustrated as a separate piece secured in place as by means of screws 50 (FIG. 7). Portions of the side wall 44 are recessed to define the chutes or ramps 26. As shown best in FIGS. 3 and 7, the container means or magazine 22 is rotatively supported atop the base 20 for rotation about the central vertical axis X—X. In this connection, the base top wall 46 has a circular central opening 52 defined by a downwardly extending tubular hub section 54 having an inwardly turned lower lip 56.

The magazine 22 has a circular bottom wall 57 which supports an elongated upper section 59 that comprises a top wall rounded at opposite ends 61, 63. Adjacent each end 61, 63 of the magazine section 59 is one of the upright tubular disc receptacles or compartments 24. Each compartment 24 is open at both its upper and lower ends. The compartments 24 extend through the bottom wall 57 so that the underside of that wall 57 is aligned with the lower ends 123 of the compartments. The compartment lower ends 123 are spaced above the top surface 120 of the base top wall 46 by less than the thickness of a disc 18 for a purpose explained below. At each upper end 62 the compartment is outwardly flared to facilitate entry of the discs into the compartment. The magazine section 59 is formed with a central portion 64 that has a downwardly extending cylindrical lower end 66. End 66 is rotatably received in hub section 54 and supported by the lower lip 56. Thus the magazine 22 is rotatively supported on the base 20.

The magazine 22 is rotated through a gear train arrangement by a battery-operated motor 68 supported within the base 20. More particularly, the motor 68 is supported in the position shown in FIGS. 7 and 8 by suitable support means (not shown). Connected to the motor output shaft 70 is a worm 72. The motor is oriented with its axis and the axis of the worm 72 generally horizontal. The worm 72 drives a worm gear 74 which is fixed to a vertically extended shaft 76 mounted between the top and bottom walls 48, 46 of the base. The shaft 76 is freely rotatable and has a small pinion gear 78 fixed adjacent its upper end. The gear 78 in turn is in driving engagement with a large gear 80 that is disposed centrally of the dispensing unit for rotation about the central vertical axis X—X. More particularly, the gear 80 has a coaxial upwardly extending cylindrical tubular hub 82 rotatably disposed around hub section 54. The upper end of hub 82 abuts an annular shoulder 55 at the upper outside of hub section 54. As shown in FIG. 7, radially inwardly of hub 82 of the large gear 80 there are an opposed pair of upwardly extending locking fingers 84 that have upper ends 86 that each extend radially outwardly to form a latch. The magazine center section 64 includes a transversely extending wall 88 which is generally aligned with the magazine bottom wall 57. The transverse wall 88 includes a pair of openings 90 through which the ends 86 of the fingers 84 extend. Each end 86 extends radially outwardly and overlies the portion of the transverse wall 88 outwardly adjacent associated opening 90 to thereby lock the gear 80 the remainder of the magazine. The fingers 84 are sufficiently resilient so that they will flex and then snap fit to the locking position shown in FIG. 7. Thus, the rotation of the motor shaft 70 is transmitted and substantially slowed down by the gear train to thereby rotate the magazine 22. The magazine may conveniently rotate at speeds in the order of about 25 rpm to about 50 rpm.

Figure 8:
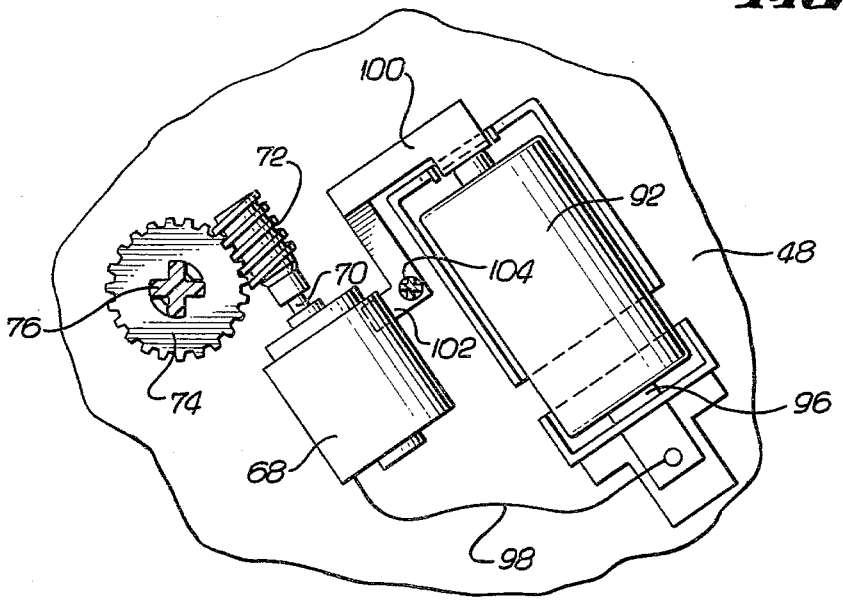
FIG. 8 is a partial sectional view taken generally along line 8—8 of FIG. 7.

FIGS. 7 and 8 illustrate the electrical circuit between the motor 68 and a source of power comprised of a size D battery 92 supported within the base 20. An opening 94 may be provided in the bottom wall 48 of the base to remove the battery and replace it when necessary. One end of the battery 92 is in contact with a metal contact 96 which is in turn connected to an electrical lead wire 98 that leads to the motor 68. The other end of the battery is in contact with another metal contact 100. The contacts 96 and 100 may be conveniently supported on the base bottom wall 48 by conventionl means (not shown). The contact 100 includes a finger portion 102 which is normally in contact with the motor 68 as illustrated in solid line FIG. 7. The finger portion 102 is mounted to permit it to resiliently be moved to the broken-line position illustrated in FIG. 7 which interrupts the electrical contact with the motor 68. Thus, the movement of the finger portion 102 acts as an on/off switch for the electrical circuit and the operation of the motor. The opening and closing of the switch 102 is controlled by the vertical movement of the control member 28. The member 28 comprises an elongated upright central stem 104 and a hand-grippable transversely extending handle 106. The stem 104 passes through an opening 114 in the wall 88, through a central hole 116 in the large gear 80, and its lower end 108 is aligned with the finger portion 102. The lower end 108 is generally X shaped in cross section while the intermediate portion is bifercated (i.e., formed with a longitudinal central opening the define two spaced apart portions).

Figure 3:
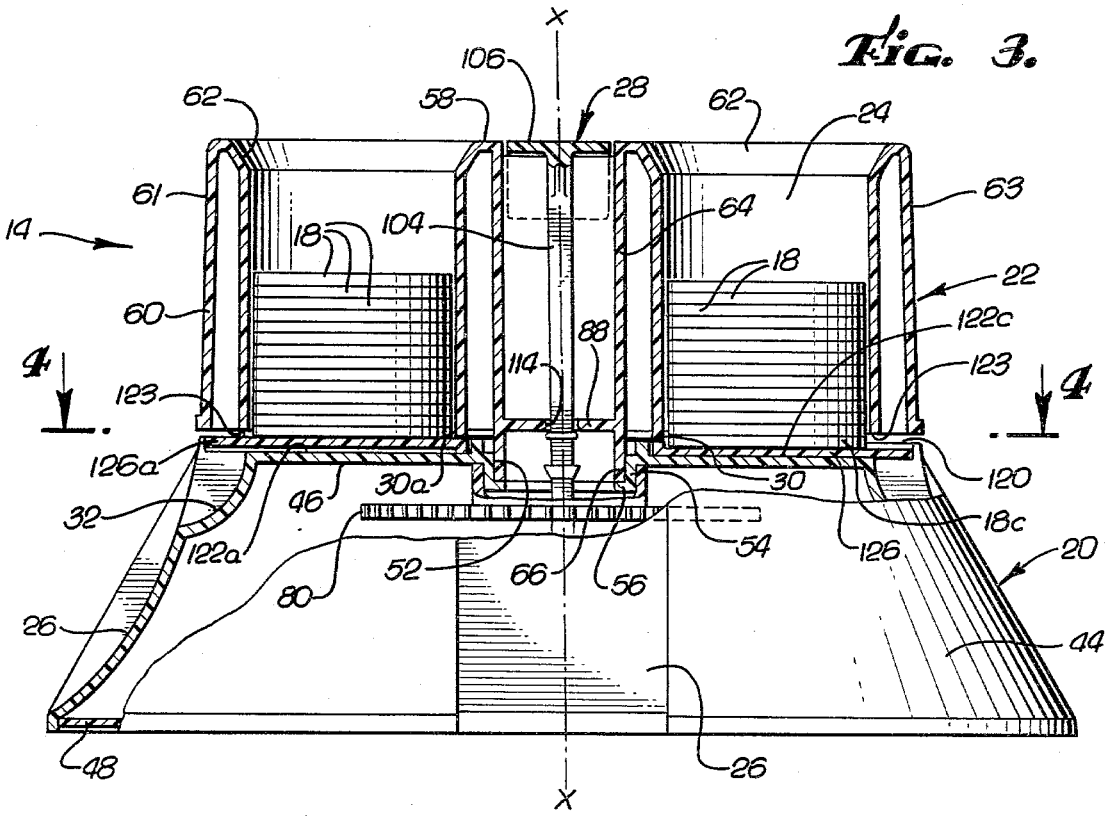
FIG. 3 is a vertical sectional view taken generally along line 3—3 of FIG. 2.

The control member 28 is shown in the elevated position in FIG. 7 whereby the end 108 is not depressing the finger portion 102 and the motor is operating to rotate the magazine 22. FIG. 3 shows the depressed or "off" position where the control member 28 is lowered and the end 108 depresses the finger portion 102 to interrupt the contact with the motor and cause the motor to stop.

Suitable means may be provided to maintain the control member 28 in each of its positions. The illustrated stem 104 is provided at its bifurcated intermediate portion with a vertically spaced apart pair of circumferential ribs, upper rib 110 and lower rib 112 which form detents.

The opening 114 receives the stem 104 therethrough for relative vertical movement but is proportioned to tend to restrict or block the passage of the ribs 110 and 112. The stem 104 is constructed of a resilient material and is bifercated as noted above, so that the stem is capable of resiliently deforming inwardly to allow the upper rib 110 (which is rounded) to be forced past the opening 114 in either axial direction. Thus, when control member 28 is depressed as shown in FIG. 3, the upper rib 110 is positioned below the wall 88, which holds it in that position against the upward urging on the lower end 108 by the finger portion 102. When the control member 28 is raised as shown in FIG. 7, the upper rib 110 is forced upwardly through the opening 114 to the upper side of the wall 88 until the lower rib 112 (which is formed at its upper end with a locking edge that extends transversely to the central axis X—X) engages the underside of wall 88. In this position the finger portion 102 is permitted to raise up and make contact with the motor as described above. Thus, the wall 88 with its central opening 114 and the stem 104 with the two ribs 110 and 112 act as a simple, inexpensive on/off switch for the device.

Figure 4:
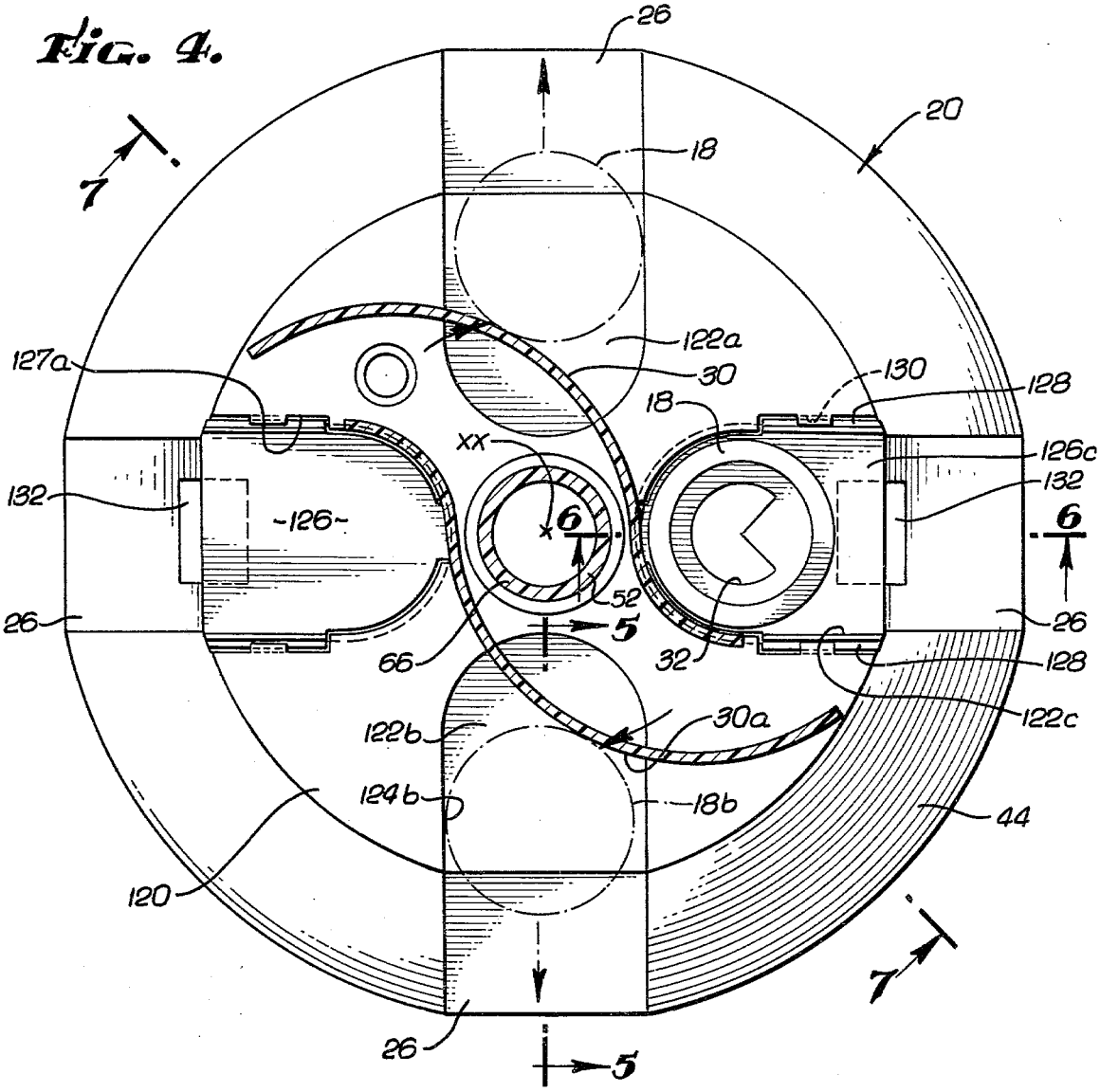
FIG. 4 is a horizontal sectional view taken generally along line 4—4 of FIG. 3.
Figure 5:
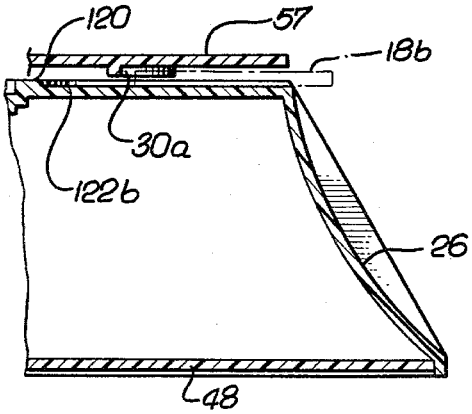
FIG. 5 is a sectional view taken generally along line 5—5 in FIG. 4.
Figure 6:
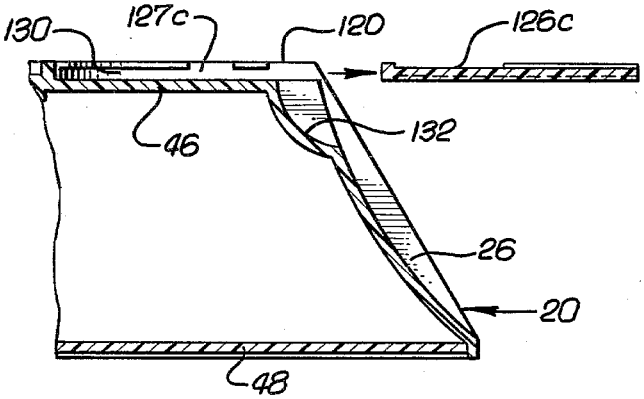
FIG. 6 is a sectional view taken generally along line 6—6 of FIG. 4.

As noted generally above, by virtue of the rotation of the magazine 22, discs from the bottom of each stack engage caming or guide surfaces on the base and on the magazine and are automatically dispensed to successive player stations. More particularly, the lowermost disc 18 in each stack slides along upper surface 120 of base top wall 46 unit it comes to a shallow recess 122. Each of the discs 18 has the same height and size, and, as noted above, the height of the space between the base surface 120 and the lower edge 123 of the disc compartment 24 is less than the height of a disc 18 so that the edge 123 engages and moves the lowermost disc in the associated stack until the disc "falls" into a recess 122. As shown in FIG. 4 there are four eject positions spaced equally around the wall 46, each inwardly of one of the ramps 26. Recesses 122*a*, 122*b* and 122*c* are illustrated at three of the eject positions. Each recess 122 is elongated, extending from the outer edge of the wall 46 (and thus in communication with an associated ramp 26) radially inwardly to a rounded inner end adjacent the center of the unit. Each recess 122 is sized to receive a disc 18 initially at its inward end as the stack of discs pass over that end, as illustrated by disc 18*c* in recess 122*c* (FIGS. 3 and 4). Each recess 122 is sufficiently shallower than the thickness of a disc so that the upper portion of a disc in a recess extends above surface 120 sufficiently to be engaged by a curved cam or guide surface 30 carried on the underside of the rotating magazine. The cam surface 30 cooperates with an edge 124 of the recess containing the disc to move the disc radially outwardly along that recess to discharge or eject it down the associated ramp. The shape of the two illustrated cam surfaces 30 is shown best in FIG. 4. Each cam surface 30 starts at the radially inner end of a recess and extends counter to the direction of rotation in a generally smooth curve that progressively moves closer to the outer edge of base top wall 46. FIG. 4 illustrates the magazine rotating clockwise. Thus, as the magazine rotates each cam surface 30 intersects each recess it encounters progressively more toward the radially outer end of the recess. FIGS. 4 and 5 illustrate a disc 18*b* (in broken line) in a recess 122*b*, and engaged by one of the cam surfaces 30*a*; the disc 18*b* has been moved from its original inward position (as described above with respect to disc 18*c*). The disc 18*b* is in effect squeezed between the cam surface 30*a* and the opposite edge 124*b* of the recess 122*b*. It will be observed that as the magazine and the cam surface 30*a* continue to rotate in the clockwise direction, that surface 30*a* will continue to urge the disc 18*b* further outward until it falls over the edge of wall 46 and down the associated ramp.

The illustrated dispenser unit will successively dispense discs to three player stations 16. It may be selectively and readily modified by the user however to dispense discs to two or four of the stations. In this connection one recess 122*c* is formed by a removable insert 126*c* as shown in FIGS. 3 and 4. This insert 126*c* is received in a mating chamber 127*c* (FIG. 6) formed in the base top wall 46. The insert 126*c* has projections 128 around its periphery that fit into mating receptacles or grooves 130 around the periphery of the chamber 127*c* to releasably retain the insert in the chamber. A cut-out 132 is provided at the outer end of chamber 127*c* and the adjacent ramp 26 for permitting the outer end of the insert 126*c* to be grasped to remove it from the chamber 127*c*. To render that eject position inoperative, the insert 126*c* may be removed (FIG. 6), turned over, and reinserted in a chamber 127*c*. FIGS. 3 and 4 show an insert 126 so reversed and positioned in chamber 127*a* within the upper surface of the insert generally flush and continuous with the adjacent surface 120 so that the stacks of discs will slide past under the urging of compartment lower edge 123 (see disc 18*a* in FIG. 3) and no disc will be dispensed at that eject position. Thus, insert 126 can be reversed to provide another recess 122*a* and thus make all four eject positions operative, or insert 126*c* can be reversed to provide a flush continuation surface rather than recess 122*c* and thus leave only two operative eject positions.

Now to consider the play of the illustrated game apparatus. As noted above, it may be set up for play by two, three or four players. Assuming that all four stations are operative, the dispensing unit 14 is placed at the center of the board 12 as shown in FIG. 1 and a control member 28 is manually raised by one of the players to energize the motor, and thereby cause the magazine 22 to rotate rapidly and continuously. As described above, the discs are dispensed from the compartments 24 down the ramps 26 to successive player stations. Each player takes the discs which are dispensed to his or her station and attempts to match the cut-outs on those discs with the projections at that station. Discs which do not match cut-outs at that station are returned to the rotating magazine compartments. The first player to match all projections at his or her station may be the winner. The rotation of the magazine may be stopped by pressing the control member 28 downwardly. The fact that there are two stacks of the discs and that the magazine rotates continuously tends to provide a good deal of randomness by which of the discs are dispensed to any particular player station.

The illustrated discs are circular and have various shapes of cut-outs 32. For example, the disc shown in FIG. 4 illustrates a cut-out in the form of a square and a cut-out in the form of $\frac{3}{4}$ of a circle. Various other shapes may be provided as seen in FIG. 1. In a preferred form, to make the game somewhat more difficult and interesting, the apparently symmetrical cut-outs (and matching projections) may be made unsymmetrical so that the disc must be oriented in a particular way for the cut-out to fit on the projection.

Figure 1:
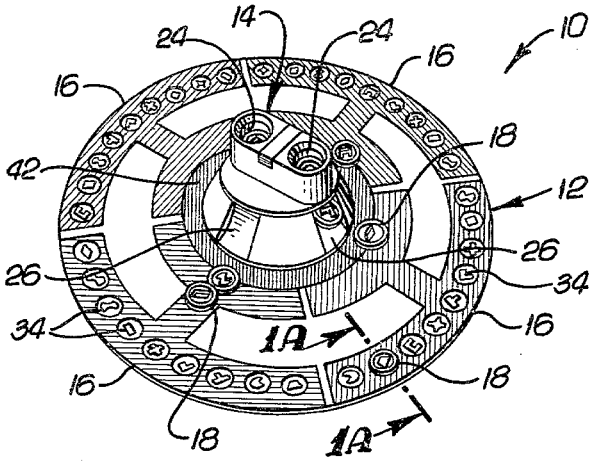
FIG. 1 is a perspective view of action game apparatus embodying a presently preferred form of the invention.
Figure 2:
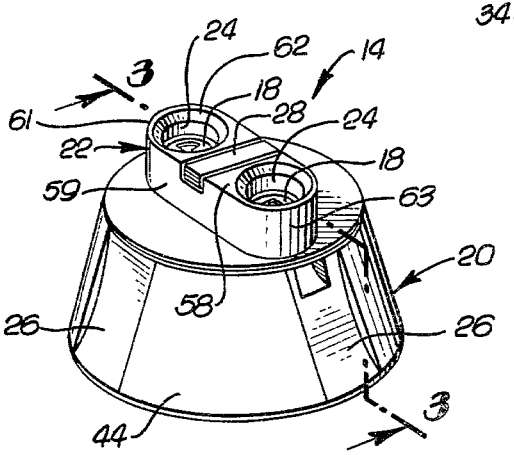
FIG. 2 is an enlarged perspective view of the disc dispensing unit of FIG. 1.

The projections 34 on the board 12 match the cut-outs 32 so that a disc may be placed in a proper circular recess 35 with the matching projection 34 received in the matching cut-out 32 (as illustrated in FIG. 1A). Various other configurations could also be utilized. While it is advantageous to utilize interengaging projections and cut-outs, the discs may bear the indicia on their surfaces and the board may simply have matching indicia for the appropriate discs to be placed upon. The board itself may be of various appropriate shapes and there may be more or less than the illustrated four player stations. Similarly, separate player cards could be substituted for the integrated stations of board 12. Color may also be utilized to provide "indicia". While circularly shaped discs are presently preferred, it may be desirable in some circumstatnces or applications to utilize other shapes or configurations of the flat discs, such as multisided discs which approximate a circular configuration. The multiple stacks used by the illustrated dispenser unit provides certain advantages such as minimizing the height of the magazine for a given quantity of discs and dispensing the discs twice as fast as if a single stack were utilized. Further distribution of the discs tends to be more random when multiple stacks are used. Nevertheless, for some applications a single stack may be desired. On the other hand more than two stacks could also be utilized if desired. Still further, other motor means might be provided such as a wind-up spring motor or the unit might be simply manually rotated by the user. Further, in lieu of batteries the device might include a cord and plug for connecting to an electrical outlet. Still further, it may be desirable to provide means for changing the speed of rotation and thereby the speed at which the discs are dispensed. If desired, the game could be played with a timer so that activity stops after a designated period of time. In one form the device might be operated to dispense a limited number of discs (one or more) to each player and then stopped, with the process then successively repeated. In the presently preferred form, however, the unit operates continuously to create a more hurried and excitement filled atmosphere for play of the game. Other changes may be made to the illustrated structure without departing from the spirit and scope of the present invention as set forth in the following claims.

What is claimed is:

1. A game apparatus in the form of a dispensing unit for sequentially and automatically dispensing thin, generally flat discs to a plurality of player stations disposed around the unit, said unit comprising:

a. base means;

b. container means mounted on said base means for relative rotation between said container means and said base means about an upright axis, said container means defining at least one vertically extending receptacle offset from said axis of rotation for receiving a stack of thin, generally flat discs;

c. means for effecting relative rotation between said base means and said container means; and d. cam means fixed on said base means and on said container means, and positioned and arranged to dispense said discs sequentially and automatically to the player stations incident to said rotation between said container means and said base means, said container means being rotatable relative to said base means and said receptacle being open at its lower end, said base means defining a generally flat, smooth, continuous, upwardly directed surface positioned to underlie said open lower end of the receptacle as the container means rotates, a plurality of circumferentially arranged recesses in said surface for receiving one of the discs from the open lower end of a receptacle as the container means rotates, each of said recesses extending radially outwardly toward an outer end that faces a player station, and a cam surface on the underside of said container means for urging a disc in a recess radially outwardly along said recess as said container means rotates.

2. The game apparatus of claim 1, wherein said means for effecting relative rotation is a motor which is disposed in said base means and effects generally continuous rotation of said container means.

3. A game apparatus in the form of a dispensing unit for sequentially and automatically dispensing thin, generally flat discs to a plurality of player stations disposed around that unit, said unit comprising:

a. base means;

b. container means mounted on said base means for relative rotation between said container means and said base means about an upright axis, said container means defining at least one vertically extending receptacle offset from said axis of rotation for receiving a stack of thin, generally flat discs;

c. means in the form of a motor disposed on said base means for effecting generally continuous rotation of said container means;

d. cam means fixed on said base means and on said container means, and positioned and arranged to dispense said discs sequentially and automatically to the player stations incident to said rotation between said container means and said base means;

e. means for starting said rotation and for stopping said rotation, said start and stop means comprises a manually operable member carried on said container means.

4. The game apparatus of claim 3, wherein said start and stop means member is vertically movable and is positioned at the upright axis of rotation of the container means.

5. The game apparatus of claim 4, wherein said vertically movable start and stop member is manually raised to start the relative rotation and is manually depressed to stop the rotation.

6. A game apparatus of claim 5, wherein said member includes an intermediate stem portion having a longitudinal axis and a pair of spaced apart detents for maintaining the start-stop member in each of its positions.

7. The game apparatus of claim 6, wherein said stem portion passes through a restricted opening proportioned to bar passage of said detents and said stem portion has a bifurcated construction and is made of a flexible resilient material permitting the stem to be deformd radially inwardly incident to axial movement of the stem portion through the opening to thereby permit passage of the detents through the opening.

8. The game apparatus of claim 3, further including a reduction gear train means connected between said motor and said container means.

9. The game apparatus of claim 3, wherein said motor comprises an electric motor.

10. The game apparatus of claim 9, further including retaining and contact means for a battery, circuit means for interconnecting the battery to the motor, and wherein said battery, motor and interconnecting means are disposed within the base means.

11. A game apparatus in the form of a dispensing unit for sequentially and automatically dispensing thin, generally flat discs to a plurality of player stations disposed around the unit, said unit comprising:

a. base means;

b. container means mounted on said base means for relative rotation between said container means and said base means about an upright axis, said container means defining at least one vertically extending receptacle offset from said axis of rotation for receiving a stack of thin, generally flat discs;

c. means in the form of a motor disposed on said base means for effecting generally continuous rotation of said container means;

d. cam means fixed on said base means and on said container means, and positioned and arranged to dispense said discs sequentially and automatically to the player stations incident to said rotation between said container means and said base means;

e. means for starting said rotation and for stopping said rotation, said motor comprising an electric motor, said game apparatus further including retaining and contact means for a battery, circuit means for interconnecting the battery to the motor, and wherein said battery, motor and interconnecting means are disposed within the base means, said game apparatus further including manually operable stop/start means on said container means and extending into said base means for selectively opening and closing said circuit means.

12. The game apparatus of claim 11, wherein said start/stop means includes an engaging portion which is positioned and arranged to move a resilient electrical contact element to open a switch and thereby de-energize said motor, when said means is operated.

13. The game apparatus of claim 1, wherein said means for effecting relative rotation is manually powered.

14. The game apparatus of claim 1, wherein said container means defines a plurality of said receptacles.

15. The game apparatus of claim 14, wherein said receptacles are circumferentially equally spaced around said axis of rotation of the container means.

16. The game apparatus of claim 1, wherein said receptacle is open at its upper end for receipt of the discs.

17. The game apparatus of claim 16, where said container means rotates relative to said base means and said receptacle is outwardly flared at said open upper end to facilitate receipt of the discs while the container means is rotating.

18. The game apparatus of claim 1, wherein said base means is provided with a downwardly extending ramp adjacent to each of said recess outer ends.

19. The game apparatus of claim 1, wherein the discs are of generally uniform height and said surface is spaced below said lower end of said receptacle by less than the height of one of said discs.

20. The game apparatus of claim 19, wherein each of said recesses has a sufficient depth relative to the height of one of said discs such that the upper portion of a disc received in a recess is spaced below the lower end of the receptacle.

21. The game apparatus of claim 20, wherein each of said recesses has a sufficient depth relative to the height of one of said discs that the upper portion of a disc received in a recess is positioned to be engaged by said cam means.

22. The game apparatus of claim 21, wherein said cam surface is a generally smooth continuous curve extending from the radially inward end of said receptacle and extending therefrom progressively radially outwardly in a direction opposite to the direction of rotation of said container means.

23. The game apparatus of claim 22, wherein said curved cam surface extends to essentially said outer end of said recess.

24. The game apparatus of claim 22, wherein there are four player stations disposed around said base means, said container means defines two receptacles, and there are two of said smoothly curved cam surfaces each associated with one of said receptacles.

25. The game apparatus of claim 1, wherein there are at least three of said recesses which each define an eject position, said apparatus further comprising conversion means at at least one of said eject positions for changing the recess at that eject position to a generally continuous extension of said surface.

26. The game apparatus of claim 25, wherein said conversion means comprises a two-sided insert and said base means is constructed at said eject position with a chamber for receiving said insert with either one or the other of its sides facing upwardly, one of said sides providing one of said recesses for receiving a disc and the other of said sides providing a surface for being aligned with and forming a continuation of said surface.

27. A game apparatus in the form of a dispensing unit for sequentially and automatically dispensing thin, generally flat discs to a plurality of player stations disposed around the unit, said unit comprising:

a. base means;

b. container means rotatably mounted on said base means for rotation about an upright axis, said container means defining at least one vertically extending generally cylindrical receptacle offset from said axis of rotation for receiving a stack of thin, generally flat and circular discs, said receptacle being open at its lower end;

c. means for effecting rotation of said container means; and d. dispensing means on said base means and on said container means, and positioned and arranged to dispense said discs sequentially and automatically to the player stations incident to said rotation of said container means on said base means, said dispensing means comprising a generally flat, smooth, continuous, upwardly directed annular surface on said base means and positioned to underlie said open lower end of the receptacle as the container means rotates, a plurality of circumferentially arranged recesses in said surface for receiving one of the discs from the open lower end of a receptacle as the container means rotates, each of said recesses extending radially outwardly toward an outer end that faces a player station, and a cam surface on the underside of said container means for urging a circular disc in a recess radially outwardly along said recess as said container means rotates.

28. The game apparatus of claim 27, wherein said cam surface is a generally smooth continuous curve extending from the radially inward end of said receptacle and extending therefrom progressively radially outwardly in a direction opposite to the direction of rotation of said container means.

29. The game apparatus of claim 28, wherein said curved cam surface extends to essentially said outer end of said recess.

30. The game apparatus of claim 29, wherein there are four player stations disposed around said base means, said container means defines two receptacles, and there are two of said smoothly curved cam surfaces each associated with one of said receptacles.

* * * * *